US005514637A

United States Patent [19]

Lum et al.

[11] Patent Number: 5,514,637

[45] Date of Patent: May 7, 1996

[54] THERMAL DYE TRANSFER DYE-DONOR ELEMENT CONTAINING TRANSFERABLE PROTECTION OVERCOAT

[75] Inventors: Kin K. Lum, Webster; John M. Noonan, Rochester, both of N.Y.

[73] Assignee: Eastman Kodak Company, Rochester, N.Y.

[21] Appl. No.: 410,659

[22] Filed: Mar. 24, 1995

[51] Int. Cl.[6] ..... B41M 5/035; B41M 5/38

[52] U.S. Cl. ..... 503/227; 428/195; 428/500; 428/522; 428/913; 428/914

[58] Field of Search ..... 8/471; 428/195, 428/913, 914, 500, 522; 503/227; 156/235

[56] References Cited

U.S. PATENT DOCUMENTS 5,332,713 7/1994 Oldfield et al. ..... 503/227

FOREIGN PATENT DOCUMENTS 2258843 2/1993 United Kingdom .

*Primary Examiner*—B. Hamilton Hess
*Attorney, Agent, or Firm*—Harold E. Cole

[57] ABSTRACT

A dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer comprises poly(vinyl benzal) having a polymethylmethacrylate equivalent molecular weight of less than about 75,000 as measured by size exclusion chromatography or poly(vinyl acetal) having a polymethylmethacrylate equivalent molecular weight of less than about 65,000 as measured by size exclusion chromatography.

23 Claims, No Drawings

THERMAL DYE TRANSFER DYE-DONOR ELEMENT CONTAINING TRANSFERABLE PROTECTION OVERCOAT

This invention relates to a dye-donor element for thermal dye transfer, and more particularly to the use of a transferable polymeric protection overcoat having a certain molecular weight in the element for transfer to a thermal print.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Thermal prints are susceptible to retransfer of dyes to adjacent surfaces and to discoloration by fingerprints. This is due to dye being at the surface of the dye-receiving layer of the print. These dyes can be driven further into the dye-receiving layer by thermally fusing the print with either hot rollers or a thermal head. This will help to reduce dye retransfer and fingerprint susceptibility, but does not eliminate these problems. However, the application of a protective overcoat will practically eliminate these problems.

U.S. Pat. No. 5,332,713 discloses a dye-donor element for thermal dye transfer wherein a region is also present on the element which is used to form a protective layer over the printed image on a dye-receiver. The protective material disclosed is a poly(vinyl formal), poly(vinyl benzal) or a poly(vinyl acetal) containing at least about 5 mole % hydroxyl. The molecular weight of these materials was not specified.

There is a problem with these materials, however, in that during the process of transferring the protective layer from the dye-donor element to the dye-receiver element, the portion of the thermally transferable material that is actually laminated to the receiver element tends to not break away cleanly from the non-laminated portion of the material, leaving objectionable ragged, uneven edges.

GB 2,258,843 discloses a method to solve the above problem. This technique involves the application of excess thermal energy at the edges of the laminated area. However, this approach is more expensive as it uses more thermal energy and is also more complicated to practice.

It is an object of this invention to provide a dye-donor element containing a portion having a transferable protection layer, wherein the portion of the thermally transferable material that is actually laminated to the receiver element will break away cleanly from the non-laminated portion of the material.

It is another object of this invention to provide a protective coat for a thermal dye transfer image which can be applied by the thermal print head and which avoids undesirable retransfer of dye to adjacent surfaces.

These and other objects are achieved in accordance with this invention which relates to a dye-donor element for thermal dye transfer comprising a support having thereon at least one dye layer area comprising an image dye in a binder and another area comprising a transferable protection layer, the transferable protection layer area being approximately equal in size to the dye layer area, wherein the transferable protection layer comprises poly(vinyl benzal) having a polymethylmethacrylate equivalent molecular weight of less than about 75,000 as measured by size exclusion chromatography or poly(vinyl acetal) having a polymethylmethacrylate equivalent molecular weight of less than about 65,000 as measured by size exclusion chromatography.

As will be shown by comparative tests hereafter, poor results are obtained if a poly(vinyl benzal) is employed having a polymethylmethacrylate equivalent molecular weight of greater than about 100,000 as measured by size exclusion chromatography or a poly(vinyl acetal) is employed having a polymethylmethacrylate equivalent molecular weight of greater than about 90,000 as measured by size exclusion chromatography.

In a preferred embodiment of the invention, the dye-donor element is a multicolor element comprising repeating color patches of yellow, magenta and cyan image dyes, respectively, dispersed in a binder, and a patch containing the protection layer.

In another embodiment of the invention, the protection layer is the only layer on the donor element and is used in conjunction with another dye-donor element which contains the image dyes.

In another preferred embodiment of the invention, the dye-donor element is a monochrome element and comprises repeating units of two areas, the first area comprising a layer of one image dye dispersed in a binder, and the second area comprising the protection layer.

In another preferred embodiment of the invention, the dye-donor element is a black-and-white element and comprises repeating units of two areas, the first area comprising a layer of a mixture of image dyes dispersed in a binder to produce a neutral color, and the second area comprising the protection layer.

In yet still another preferred embodiment of the invention, the protection layer comprises:

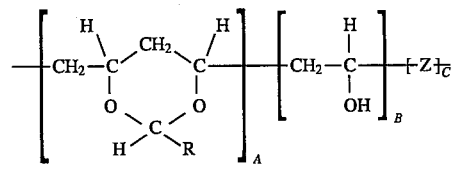

wherein:

R is $CH_3$ or $C_6H_5$;

A is at least about 25 mole percent;

B is from about 5 to about 50 mole percent;

Z is another monomer different from A and B such as vinyl acetate, vinyl chloride, styrene, methyl methacrylate, butyl acrylate, isopropyl acrylamide, and acrylate ionomer;

A+B is at least about 65 mole percent;

A+B+C=100; and wherein the molecular weight of the polymer is as described above.

The present invention provides a protective overcoat layer applied to a thermal print by uniform application of heat using a thermal head. After transfer to the thermal print, the protective layer provides superior protection against image deterioration due to exposure to light, common chemicals, such as grease and oil from fingerprints, and plasticizers from film album pages or sleeves made of poly(vinyl chloride). The protection layer is generally applied in a concentration of at least about 0.05 g/m$^2$.

In use, yellow, magenta and cyan dyes are thermally transferred from a dye-donor element to form an image on the dye-receiving sheet. The thermal head is then used to transfer a clear protective layer, from another clear patch on the dye-donor element or from a separate donor element, onto the imaged receiving sheet by uniform application of heat. The clear protective layer adheres to the print and is released from the donor support in the area where heat is applied.

Materials included within the scope of the invention include the following:

1) Poly(vinyl benzal) (55% benzal, 26% hydroxyl and 19% acetate) in 2-butanone solvent, having a polymethylmethacrylate equivalent molecular weight of about 64,000 as measured by size exclusion chromatography.
2) Poly(vinyl acetal) KS-100 (Sekisui Co) (25 mole % hydroxyl, 73 mole % acetal and 2 mole % acetate) in a 3-pentanone/methanol solvent mixture (75/25), having a polymethylmethacrylate equivalent molecular weight of about 38,000 as measured by size exclusion chromatography.
3) Poly(vinyl acetal) KS-10 (Sekisui Co) (18 mole % hydroxyl, 80 mole % acetal, 23% acetate) in a 3-pentanone/methanol solvent mixture (75/25), having a polymethylmethacrylate equivalent molecular weight of about 56,000 as measured by size exclusion chromatography.

Organic or inorganic particles may also be added to the protective layer in an amount of up to about 75% of the transferable protection layer, as described in U.S. Pat. No. 5,387,573, the disclosure of which is hereby incorporated by reference. Particularly good results have been obtained with particles of divinylbenzene beads (average diameter of 3 μm).

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

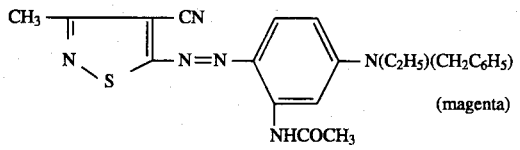

(magenta)

-continued

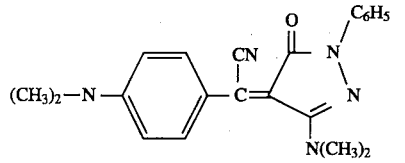

(magenta)

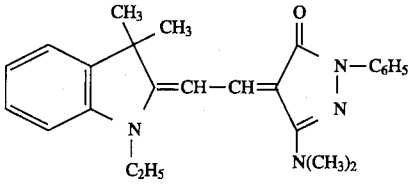

(yellow)

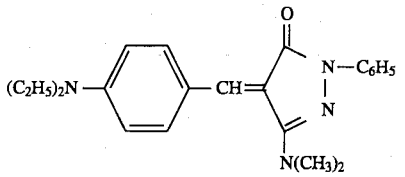

(yellow)

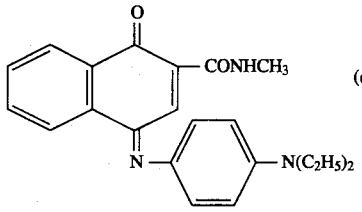

(cyan)

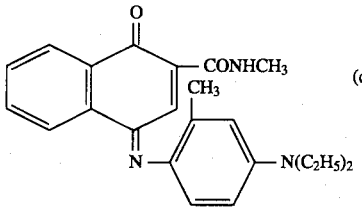

(cyan)

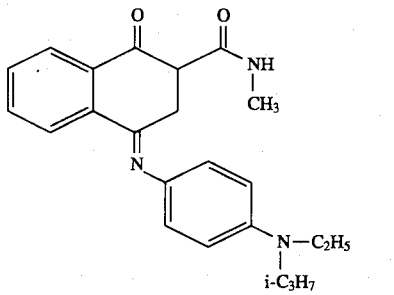

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layers and protection layer of the dye-donor element may be coated on the support or printed thereon by a printing technique such as a gravure process.

A slipping layer may be used on the back side of the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly-(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as poly(vinylidene fluoride) or poly-(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

The dye-receiving element that is used with the dye-donor element of the invention usually comprises a support having thereon a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly-(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye donor elements of the invention are used to form a dye transfer image. Such a process comprises imagewise heating a dye-donor element as described above and transferring a dye image to a dye receiving element to form the dye transfer image. After the dye image is transferred, the protection layer is then transferred on top of the dye image.

The dye donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the protection layer noted above, and the above process steps are sequentially performed for each color to obtain a three-color dye transfer image with a protection layer on top. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner. Finally, the protection layer is applied on top.

The following example is provided to illustrate the invention.

EXAMPLE

A protective layer donor element was prepared by coating on a 6 μm poly(ethylene terephthalate) support:

1) a subbing layer of titanium alkoxide (DuPont Tyzor TBT)® (0.12 g/m$^2$) from a n-propyl acetate and n-butyl alcohol solvent mixture, and 2) a slipping layer containing an aminopropyldimethyl-terminated polydimethylsiloxane, PS513® (Petrarch Systems, Inc.)(0.01 g/m$^2$), a poly(vinyl acetal) binder, KS-1 (Sekisui Co.) (0.38 g/m$^2$), p-toluenesulfonic acid (0.0003 g/m$^2$) and candellila wax (0.02 g/m$^2$) coated from a solvent mixture of diethyl ketone and methanol.

The other side of the donor element was coated with a solution of the polymer as listed in the Table in 3-pentanone onto the bare side of the above substrate. Each coating contained 0.45 g/m$^2$ of the polymer and 0.09 g/m$^2$ of divinylbenzene beads (average diameter of 4 μm).

Dye-donor elements were prepared by coating on a 6 μm poly(ethylene terephthalate) support:

1) a subbing layer of titanium alkoxide (DuPont Tyzor TBT)® (0.13 g/m$^2$) from a n-propyl acetate and n-butyl alcohol solvent mixture, and 2) repeating yellow, magenta and cyan dye patches containing the compositions as noted below.

On the back side of the element were coated the subbing layer and slipping layer as described above.

The yellow composition contained 0.27 g/m$^2$ of the first yellow dye illustrated above, 0.29 g/m$^2$ of CAP482-20 (20 s viscosity) cellulose acetate propionate, 0.07 g/m$^2$ of CAP482-0.5 (0.5 s viscosity) cellulose acetate propionate, 0.002 g/m$^2$ of FC-430® fluorocarbon surfactant (3M Corp.) and 0.005 g/m$^2$ divinylbenzene beads (2 μm beads) in a solvent mixture of toluene, methanol and cyclopentanone (66.5/28.5/5).

The magenta composition contained 0.17 g/m$^2$ of the first magenta dye illustrated above,. 0.18 g/m$^2$ of the second magenta dye illustrated above, 0.31 g/m$^2$ of CAP482-20 (20 s viscosity) cellulose acetate propionate, 0.06 g/m$^2$ of monomeric glass illustrated below, 0.002 g/m$^2$ of FC-430® fluorocarbon surfactant (3M Corp.) and 0.006 g/m$^2$ divinylbenzene beads (2 μm beads) in a solvent mixture of toluene, methanol and cyclopentanone (66.5/28.5/5).

The cyan composition contained 0.13 g/m$^2$ of the first cyan dye illustrated above, 0.12 g/m$^2$ of the second cyan dye illustrated above, 0.28 g/m$^2$ of the third cyan dye illustrated above, 0.30 g/m$^2$ of CAP482- 20 (20 s viscosity) cellulose acetate propionate, 0.0005 g/m$^2$ of FC-430® fluorocarbon surfactant (3M Corp.) and 0.006 g/m$^2$ divinylbenzene beads (2 μm beads) in a solvent mixture of toluene, methanol and cyclopentanone (66.5/28.5/5).

Monomeric Glass

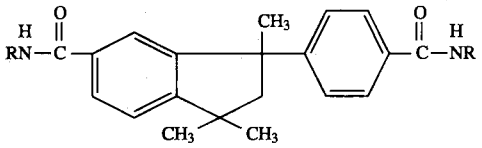

wherein R is

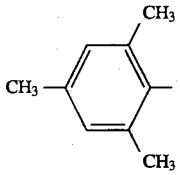

The dye-receiving element was prepared by coating a subbing layer of 0.11 g/m$^2$ Dow Z-6020 (an aminoalkylene-amino-trimethoxysilane available from Dow Corning Co.) in 99% ethanol/1% water onto a microvoided polypropylene support with a poly(vinyl alcohol)/poly(ethylene oxide) antistatic backing layer. The following receiving and overcoat layers were then simultaneously coated over the subbing layer.

Receiving Layer:

1.78 g/m$^2$ of KL3-1013 polyether-modified bisphenol A polycarbonate identified below 1.45 g/m$^2$ Lexan® 141-112 bisphenol A polycarbonate (General Electrical Co.)

0.32 g/m$^2$ diphenyl phthalate 0.32 g/m$^2$ dibutyl phthalate 0.01 g/m$^2$ FC-431® fluorocarbon surfactant (3M Corp.)

Solvent: Methylene chloride

Receiver Overcoat:

0.21 g/m$^2$ polycarbonate random terpolymer 0.01 g/m$^2$ DC-510 silicone surfactant (Dow-Corning)

0.02 g/m$^2$ FC-431® fluorocarbon surfactant (3M Corp.)

Solvent: methylene chloride

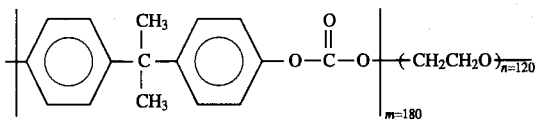

KL3-1013, block copolymer of polyether glycol and bisphenol A polycarbonate (Bayer AG)

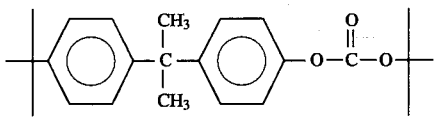

Bisphenol A polycarbonate Lexan 141-112® (General Electric Company)

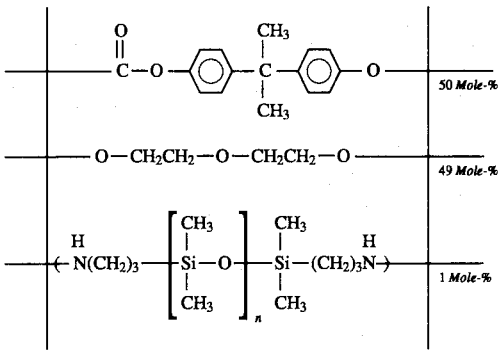

Polycarbonate random terpolymer made from bisphenol A, diethylene glycol and PS510 (a polydimethylsiloxane available from Huels America).

The dye side of the dye-donor elements described above, in a strip about 10×14 cm in area, was placed in contact with the dye image-receiving layer of a dye-receiver element, as described above, of the same area. The assemblage was clamped to a stepper-motor driving a 53 mm diameter rubber roller, and a TDK Thermal Head (No. L-231) (thermostatted at 30° C.) was pressed with a force of 24.5N against the dye-donor element side of the assemblage pushing it against the rubber roller. (The TDK L-231 thermal print head has 512 independently addressable heaters with a resolution of 5.4 dots/mm and an active printing width of 95 mm, of average heater resistance 512 ohms.)

The imaging electronics were activated and the assemblage was drawn between the printing head and roller at 20.6 mm/sec. Coincidentally, the resistive elements in the thermal print head were pulsed on for 128 μsec every 130 μsec. Printing maximum density requires 63 pulses "on" time per printed line of 9.0 msec. The voltage supplied was 12.65 volts resulting in an instantaneous peak power of approximately 0.313 Watts/dot and the maximum total energy required to print 2.3 Dmax was 2.52 mjoule/dot. The image was printed with a 1:1 aspect ratio. This printing scheme was repeated in succession for each of the three-color dye-donor elements.

The lamination was carried out in a printer similar to the commercially available XLS-8300 made by Eastman Kodak Company. The printer had been modified to print faster at 5 ms per line. The lamination procedure (transferring a protective layer from its patch on a donor onto the receiver element) was approximately 200 mjoule/dot. The loose protective layer on the side edge and on the trailing edge were measured.

The laminate samples were then evaluated for resistance to retransfer to a poly(vinyl chloride)-coated substrate. Poly(vinyl chloride) sheets (PVC sheets) were placed in contact with the printed image. The images and PVC sheets were placed in a stack. A 1 kg weight was placed on top of the approximately 10 by 14 cm prints. The stacked prints plus weight were placed in a 50° C./60% RH oven for 7 days. An average of the Status A Transmission densities of the now dye-stained PVC sheets were read for dye uptake.

The side edges and trailing edges of the element were also measured to evaluate the jagged edges. The following results were obtained:

TABLE

| Polymer | Mol. Wt.* (1000) | Side Edge (mm) | Trailing Edge (mm) | Retransfer To PVC (Visual Dens.) |
|---|---|---|---|---|
| Control 1 | 92 | 1.5 | 8.6 | 0 |
| 3 | 56 | 0.5 | 2.2 | 0.01 |
| 2 | 38 | 0 | 0 | 0.02 |
| Control 2 | 282 | 1.0 | 8.2 | 0.01 |
| Control 3 | 102 | 1.0 | 4.2 | 0.02 |
| 1 | 64 | 0 | 0.5 | 0.02 |

*Polymethylmethacrylate equivalent molecular weight as measured by size exclusion chromatography.

Control 1: Poly(vinyl acetal) KS-1 (Sekisui Co) (24 mole % hydroxyl, 76 mole % acetal) in a 3-pentanone/methanol solvent mixture (75/25) (Polymer 4 in U.S. Pat. No. 5,332,713).

Control 2: Poly(vinyl benzal) (51% benzal, 28% hydroxyl and 21% acetate) in 2-butanone solvent.

Control 3: Poly(vinyl benzal) (53% benzal, 28% hydroxyl and 19% acetate) in 2-butanone solvent.

The above results show that the polymers used in accordance with the invention had significantly improved edge properties (side edge and trailing edges were very small or zero) as compared to control polymers with higher molecular weights. The results also show that the polymers used in accordance with the invention have good retransfer properties.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon at least one dye layer area comprising an image dye in a binder and another area comprising a transferable protection layer, said transferable protection layer area being approximately equal in size to said dye layer area, wherein said transferable protection layer comprises poly(vinyl benzal) having a polymethylmethacrylate equivalent molecular weight of less than about 75,000 as measured by size exclusion chromatography or poly(vinyl acetal) having a polymethylmethacrylate equivalent molecular weight of less than about 65,000 as measured by size exclusion chromatography.

2. The element of claim 1 wherein said transferable protection layer comprises poly(vinyl acetal).

3. The element of claim 1 wherein said transferable protection layer comprises:

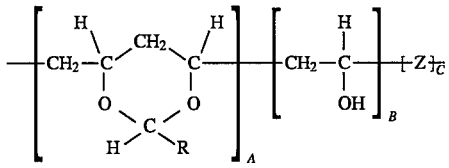

wherein:

R is $CH_3$ or $C_6H_5$;

A is at least about 25 mole percent;

B is from about 5 to about 50 mole percent;

Z is another monomer different from A and B;

A+B is at least about 65 mole percent;

A+B+C=100.

4. The element of claim 3 wherein A+B= 100 mole percent.

5. The element of claim 3 wherein C is vinyl acetate.

6. The element of claim 3 wherein Z is vinyl acetate, vinyl chloride, styrene, methyl methacrylate, butyl acrylate, isopropyl acrylamide or acrylate ionomer.

7. The element of claim 1 wherein said dye-donor element is a multicolor element comprising repeating color patches of yellow, magenta and cyan image dyes, respectively, dispersed in a binder, and a patch containing said protection layer.

8. A process of forming a protection layer on top of a thermal dye transfer image comprising:

(a) imagewise-heating a dye-donor element comprising a support having thereon a dye layer comprising an image dye in a binder, said dye-donor being in contact with a dye-receiving element, thereby transferring a dye image to said dye-receiving element to form said dye transfer image; and (b) thermally transferring a protection layer on top of said transferred dye image, said protection layer being applied from an element which contains a layer comprising poly(vinyl benzal) having a polymethylmethacrylate equivalent molecular weight of less than about 75,000 as measured by size exclusion chromatography or poly(vinyl acetal) having a polymethylmethacrylate equivalent molecular weight of less than about 65,000 as measured by size exclusion chromatography.

9. The process of claim 8 wherein said protection layer is present on a separate area of said dye-donor element.

10. The process of claim 8 wherein said protection layer is present on a separate donor element.

11. The process of claim 8 wherein said transferable protection layer comprises poly(vinyl acetal).

12. The process of claim 8 wherein said transferable protection layer comprises:

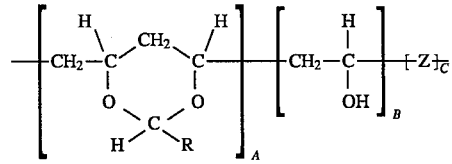

wherein:

R is $CH_3$ or $C_6H_5$;

A is at least about 25 mole percent;

B is from about 5 to about 50 mole percent;

Z is another monomer different from A and B;

A+B is at least about 65 mole percent;

A+B+C=100.

13. The process of claim 12 wherein A+B= 100 mole percent.

14. The process of claim 12 wherein C is vinyl acetate.

15. The process of claim 12 wherein Z is vinyl acetate, vinyl chloride, styrene, methyl methacrylate, butyl acrylate, isopropyl acrylamide or acrylate ionomer.

16. The process of claim 8 wherein said dye-donor element is a multicolor element comprising repeating color patches of yellow, magenta and cyan image dyes, respectively, dispersed in a binder, and a patch containing said protection layer.

17. A thermal dye transfer assemblage comprising (a) a dye-donor element for thermal dye transfer comprising a support having thereon at least one dye layer area comprising an image dye in a binder and another area comprising a transferable protection layer, said transferable protection layer area being approximately equal in size to said dye layer area, wherein said transferable protection layer comprises poly(vinyl benzal) having a polymethylmethacrylate equivalent molecular weight of less than about 75,000 as measured by size exclusion chromatography or poly(vinyl acetal) having a polymethylmethacrylate equivalent molecular weight of less than about 65,000 as measured by size exclusion chromatography; and (b) a dye-receiving element comprising a support having thereon a dye image-receiving layer, said dye-receiving element being in a superposed relationship with said dye-donor element so that said dye layer is in contact with said dye image-receiving layer.

18. The assemblage of claim 17 wherein said transferable protection layer comprises poly(vinyl acetal).

19. The assemblage of claim 17 wherein said transferable protection layer comprises:

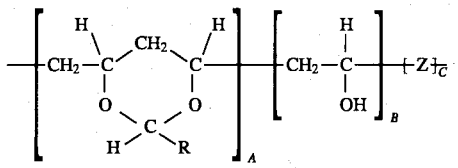

wherein:

R is $CH_3$ or $C_6H_5$;

A is at least about 25 mole percent;

B is from about 5 to about 50 mole percent;

Z is another monomer different from A and B;

A+B is at least about 65 mole percent;

A+B+C=100.

20. The assemblage of claim 19 wherein A+B= 100 mole percent.

21. The assemblage of claim 19 wherein C is vinyl acetate.

22. The assemblage of claim 19 wherein Z is vinyl acetate, vinyl chloride, styrene, methyl methacrylate, butyl acrylate, isopropyl acrylamide or acrylate ionomer.

23. The assemblage of claim 17 wherein said dye-donor element is a multicolor element comprising repeating color patches of yellow, magenta and cyan image dyes, respectively, dispersed in a binder, and a patch containing said protection layer.

* * * * *